United States Patent [19]

Daisley et al.

[11] 4,076,115

[45] Feb. 28, 1978

[54] APPARATUS FOR HANDLING ROD-LIKE ARTICLES

[75] Inventors: Robert Thomas Daisley; David Charles Philip Chumley, both of London, England

[73] Assignee: Molins Limited, England

[21] Appl. No.: 680,224

[22] Filed: Apr. 26, 1976

[30] Foreign Application Priority Data

Apr. 25, 1975 United Kingdom ..... 17161/75

[51] Int. Cl.[2] ..... B65G 47/00; B65G 45/00

[52] U.S. Cl. ..... 198/487; 198/494; 198/740; 53/148; 53/164

[58] Field of Search ..... 198/425, 426, 429, 430, 198/472, 485, 487, 494, 496, 740, 597; 131/25; 53/148, 159, 160, 164, 166, 167; 214/8.555, 301, 302

[56] References Cited

U.S. PATENT DOCUMENTS

| | | | |
|---|---|---|---|
| 932,981 | 8/1909 | Goff | 198/496 |
| 2,983,361 | 5/1961 | Tibbals | 198/430 |
| 3,040,867 | 6/1962 | Posten et al. | 198/430 |
| 3,106,810 | 10/1963 | Pembroke | 53/148 |

FOREIGN PATENT DOCUMENTS

| | | | |
|---|---|---|---|
| 1,404,141 | 8/1975 | United Kingdom | 214/302 |

*Primary Examiner*—Evon C. Blunk
*Assistant Examiner*—Joseph E. Valenza
*Attorney, Agent, or Firm*—Craig & Antonelli

[57] ABSTRACT

A plunger assembly for moving a batch of rod-like articles, principally from a conveyor into a tray, is provided with locating means, such as a flexible strip, which is movable with the plunger and which exerts light pressure on the top of a batch to control the articles as they are transferred.

17 Claims, 2 Drawing Figures

APPARATUS FOR HANDLING ROD-LIKE ARTICLES

This invention relates to apparatus for handling rod-like articles and one aspect of the invention is particularly concerned with apparatus for filling a container with rod-like articles.

U.S.A. Pat. Application No. 648,926, the disclosure of which is hereby incorporated herein in full, discloses an arrangement for filling a container with cigarettes by successively inserting batches of cigarettes. The batches may be formed on a conveyor by divider plates which can be inserted into a continuous stream of cigarettes moving transverse to their lengths on the conveyor. The container and conveyor may be moved intermittently and batches plunged, in a direction lengthwise of the cigarettes, off the conveyor into the container by a piston-type stack pusher or plunger while the container and conveyor are stationary.

Each container may consist of a tray capable of holding several batches of cigarettes on top of one another. After each operation of the pusher the tray may be moved vertically through a distance approximately equal to the height of a batch of cigarettes, so that another batch can be placed on top of the previous batch. Instead of being plunged directly from the conveyor into a tray, the batches of cigarettes may be moved first onto a transfer plate which subsequently moves with the pusher and carries each batch into the container before being withdrawn prior to withdrawal of the pusher.

According to the present invention apparatus for handling rod-like articles comprises a pusher for moving a batch comprising a stack of rod-like articles in a direction parallel to the lengths of the articles, means for moving said pusher in a feed stroke, and locating means arranged to move with the pusher and adapted to exert light pressure on the upper surface of the batch. The rod-like articles in a batch, especially those near the top of the batch, are positively held by the locating means while the batch is moved by the pusher. In a preferred arrangement the locating means or part thereof is movable to accommodate changes in the level of said upper surface.

The locating means may comprise a cam-operated pivoted linkage connected to the pusher, and preferably includes at least one flexible resilient strip which may be moved into contact with the batch. The pressure on the batch may be provided by gravity, acting on all or part of the locating means, or may be provided or modified by resilient means (e.g. the resilient strip).

In an arrangement intended for use with tray filling apparatus as hereinbefore described the strip preferably extends the whole width of the batch and is arranged to be applied near the ends of the cigarettes remote from the pusher. In the case of filter-tipped cigarettes this means that the strip will usually apply pressure on the filter tips only.

The locating means is preferably able to apply pressure at different levels, both to accommodate different heights of batch and to follow, within predetermined limits, changes in the level at which the batch is moved by the pusher. In this respect it may be noted that when a batch of cigarettes is plunged into a tray on top of another batch there is usually initially a slight gap arranged between the two batches to avoid the possibility of damage to the upper cigarettes in the lower batch as the upper batch is moved into the tray. The upper batch therefore drops through a small distance onto the lower batch: the locating means should continue to exert even pressure on the top of the upper batch as it falls. This helps to maintain the batch in compact formation, to provide some degree of positive downward pressure, and to prevent bounce and possible misalignment of the upper cigarettes in the upper batch.

The invention will now be further described, by way of example only, with reference to the accompanying drawings in which.

The apparatus of the present invention is shown embodied in tray filling apparatus which is described in detail in U.S.A. Pat. application No. 648,926. Reference is directed to that application for a full description of the structure and operation of the tray filling apparatus. The Figures of the present application correspond to FIG. 2 of said application.

Figure 1:
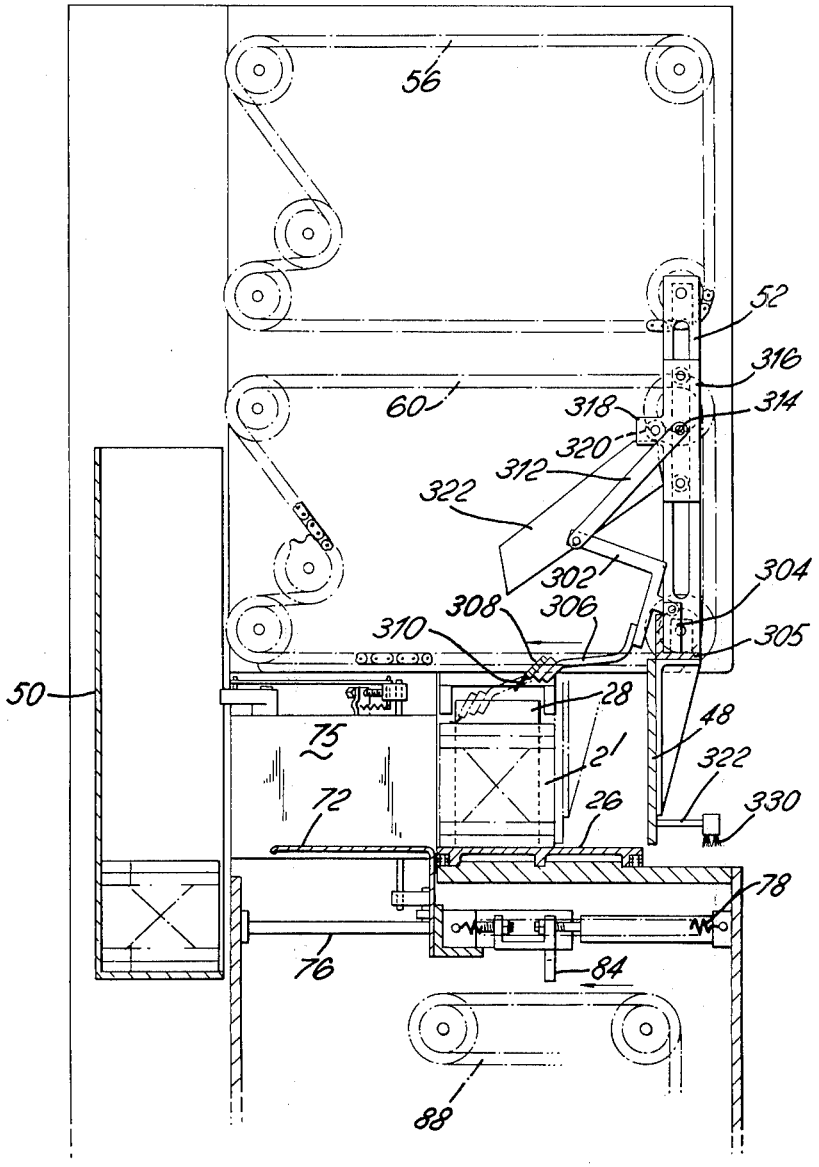
FIG. 1 is a sectional view of apparatus for filling trays with cigarettes.

FIG. 1 shows a batch 2′ comprising a stack of cigarettes supported on an endless conveyor 26. The batch 2′ is confined at its ends by divider plates 28, only one of which can be seen in the drawing. A plunger 48 is arranged on the opposite side of the batch 2′ to a container or tray 50. The spacing between adjacent divider plates 28 on the conveyor 26, the width of the plunger 48 (measured along the conveyor 26) and the corresponding dimension of the tray 50 are substantially equal. A pair of fixed side plates 75, also spaced by the same distance, extends between the conveyor 26 and the tray 50. A transfer plate 72 is arranged between plates 75 at the same level as the conveyor 26.

The plunger 48 is supported at each end by a vertical drive arm 52 rigidly attached to the plunger. Each drive arm 52 is connected by means of pivoted links for drive by upper and lower parallel drive chains 56 and 60 respectively.

The transfer plate 72 is movably supported on a pair of spaced rods 76 (only one of which is shown in the drawing) and may be moved against the resistance of return springs 78 by means of a drive chain 88 which carries a drive lug for engagement with a lug 84 rigidly connected to the transfer plate. The drive chain 88 is synchronised with the chains 56 and 60.

An angle bracket 302 is pivotally connected to a support 304 rigidly attached to a channel section 305 connected to the plunger 48, the support being positioned some distance in from one of the ends of the plunger. A similar support and angle bracket are positioned at the same distance from the other end of the plunger. The lower arm of each bracket 302 is connected to one end of a cranked lever 306, the other end of which is connected to a mounting bracket 308 for a flexible resilient strip 310 of plastics material. The bracket 308 and strip 310 extend between the levers 306 and beyond so that they are of substantially the same length as the plunger 48.

The upper arm of each bracket 302 is pivotally linked by a lever 312 to a rod 314 which extends between the drive links 52. The ends of the rod 314 are connected to members 316 slidably mounted on the respective links 52. The slide members 316 each carry an extension 318 supporting a roller 320 which is engageable with a cam surface 322 attached to a fixed side plate of the apparatus.

A brush member 330 which extends the length of the plunger 48 is attached to the rear of the plunger by spacing brackets 332 (only one of which can be seen in the drawings).

In FIG. 1 the apparatus is shown in a position just prior to the operative stroke of the plunger 48. The rollers 320 are supported on upper flat parts of the cam surface 322 so that the brackets 302 are held in an angular position such that the strip 310 is well above the surface of the batch 2'. During the operative stroke the chains 56 and 60 convey the links 52 and plunger 48 towards the tray 50 while maintaining the links and plunger vertical. As the links 52 are moved forward the rollers 320 simultaneously move down the cam surfaces 322 allowing the slide members 316 to move down the links 52 so that the brackets 302 rotate (counter-clockwise as shown in FIG. 1) and lower the strip 310 onto the batch 2'.

At about the same time as the plunger 48 first engages the batch 2' the strip 310 is moved into full engagement with the upper cigarettes in the batch. In this position, indicated for the strip 310 and plunger 48 by chain-dotted lines in FIG. 1, the angle brackets 302 have been stopped by abutment with the channel section 305 and the rollers 320 are already just clear of the cam surfaces 322. The relevant dimensions are such that the strip 310 is bent into a substantially horizontal position, at least at its end, so that it lies parallel to the surface of the batch and applies a locating pressure to the batch. The strip 310 makes contact with the ends of the cigarettes away from the plunger, i.e. the filter tipped ends of the cigarettes.

Figure 2:
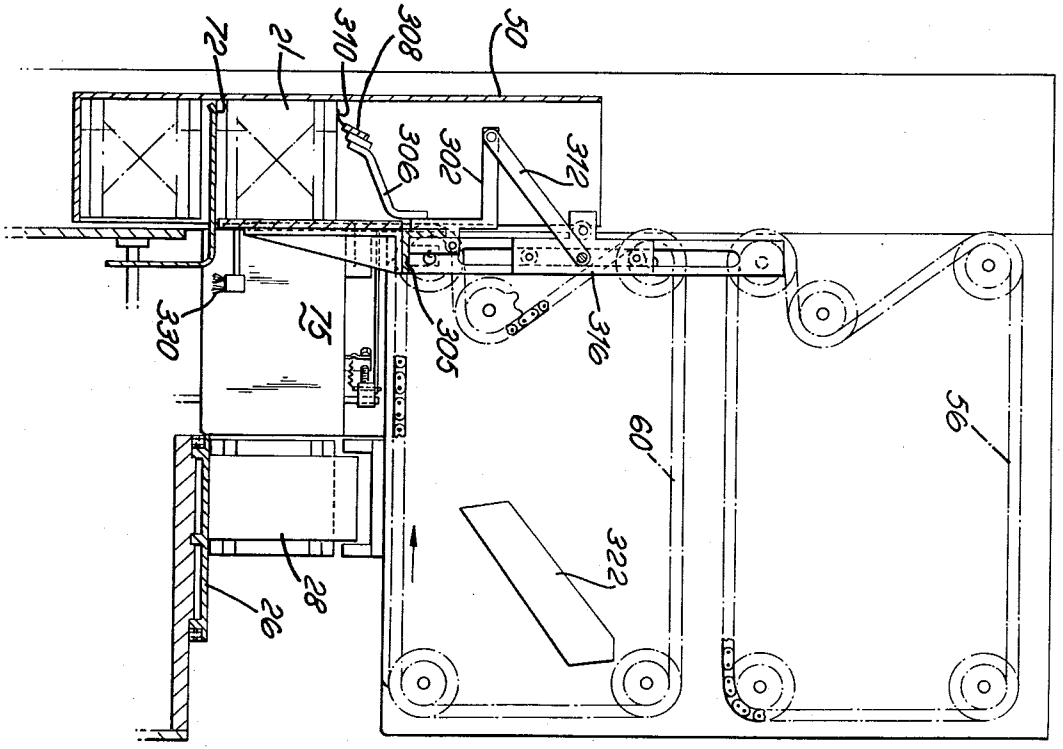
FIG. 2 is a view similar to FIG. 1 but with the apparatus in a different operative position.

The strip 310 stays in position and helps to keep the batch 2' in compact formation as the plunger 48 moves the batch onto the transfer plate 72. The chains 56 and 60 and 88 are so synchronised that, as soon as the batch is on the transfer plate 72, the plunger 48 and transfer plate are driven forward at about the same speed until the batch and transfer plate occupy a position within the tray 50 just above the bottom of the tray or the top of the previous batch. This position is shown in FIG. 2.

At this stage the lug on drive chain 88 ceases to engage the lug 84 and the transfer plate 72 is rapidly withdrawn by its return springs 78. The batch 2' is held in the tray 50 by the plunger 48 and falls a short distance onto the top of the previous batch. The strip 310 remains in contact with the upper surface of the batch 2' as it falls, to prevent bounce and possible misalignment of the cigarettes in the batch. Thus the strip helps to maintain the batch in compact formation by providing some degree of positive downward pressure as the batch falls.

It will be realised that, since further rotation of the brackets 302 is prevented by the section 305, the strip 310 maintains contact with the batch (as the batch falls) by virtue of its own dimensions and resilience. In an alternative arrangement the brackets 302 (and slide members 306) could be arranged so that the strip 310 fully contacts the batch before they engage any stops. Thus the weight of the brackets and associated linkage would be partly supported by the pressure of the strip on the batch. With this alternative arrangement some rotational movement of the brackets 302 would occur as the batch descended in the tray.

After the batch 2' has been deposited in the tray 50, the plunger 48, drive links 52 and associated linkage are moved away by the drive chains 56 and 60 and are conveyed back to the position shown in FIG. 1 via the upper run of chains 56 and 60. During most of this return journey the brackets 302 remain against the stop provided by section 305 but are finally returned to the primed position shown in FIG. 1 by engagement of the rollers 320 with the flat upper part of cam surface 322 as the drive links 52 descend the vertical run of drive chains 56 and 60. During the return journey of the plunger etc. the tray 50 is stepped downwards by the height of a batch in readiness for receiving the next batch.

The purpose of the brush 330 is to sweep from the conveyor 26 loose tobacco or "shorts" which may have fallen from cigarettes on the conveyor. It can be seen that such loose tobacco will be swept into the gap which opens up between the transfer plate 72 and the conveyor 26. For this purpose a collecting tray may be arranged in this gap below the position of the transfer plate in FIG. 1. The collecting tray may be inclined and/or be vibrated to move collected loose tobacco to a further collection position.

We claim:

1. Apparatus for handling rod-like articles, comprising conveyor means for delivering a stream of rod-like articles in a direction transverse to their lengths, said conveyor means including divider means for separating said stream into batches, each batch comprising a stack of said articles, pusher means including a pusher for moving batches off said conveyor means in a direction parallel to the lengths of said articles, drive means for moving said pusher in a feed stroke, locating means arranged to move with the pusher and adapted to exert light pressure on the upper surface of the batch during said feed stroke, means responsive to said drive means for moving said locating means relative to said pusher from a primed position in which it is spaced above said stack downwardly into its operative position in contact with the top of a batch adjacent one longitudinal edge thereof as said pusher moves through a feed stroke, at least a part of said locating means being movable independently of said moving means to accommodate changes in the level of said upper surface, and means for supporting a container in a position to receive a batch from said pusher so that at the end of a feed stroke the locating means extends into the container and continues to exert light pressure on the upper surface of the batch.

2. Apparatus as claimed in claim 1, wherein said moving means comprises at least one cam surface, a follower member for engagement with said cam surface, and connection means for connecting said follower member to said locating means.

3. Apparatus as claimed in claim 2, in which said connection means comprises a member pivotally mounted relative to said pusher and having first and second projecting portions, one of said projecting portions being connected to said follower member and the other projecting member being connected to said locating means.

4. Apparatus as claimed in claim 1, wherein said locating means includes a resilient member for contacting the upper surface of a batch.

5. Apparatus as claimed in claim 4, wherein said resilient member includes a flexible strip which makes contact along the length of a batch.

6. Apparatus as claimed in claim 4 wherein said locating means is arranged to rest on the upper surface of a batch under its own weight during a portion of said feed stroke.

7. Apparatus as claimed in claim 1, further including a movable transfer plate arranged between said conveyor means and said container support means so that batches moved by said pusher off said conveyor means are received on said transfer plate, means for moving said transfer plate with said pusher, said transfer plate being arranged to move into a container while supporting a batch, and means for withdrawing the transfer plate while maintaining the position of the pusher, whereby the batch on the transfer plate may be deposited in the container.

8. Apparatus as claimed in claim 7, wherein said container support means includes means for intermittently moving a container to receive successive batches on top of one another.

9. Apparatus as claimed in claim 7, wherein said locating means is arranged so that it extends into said container ahead of said pusher and continues to exert light pressure on the batch after withdrawal of the transfer plate.

10. Apparatus as claimed in claim 1, including means for returning said pusher and said locating means along a different path after said feed stroke.

11. Apparatus for handling rod-like articles, comprising a pusher for moving a batch comprising a stack of rod-like articles in a direction parallel to the lengths of the articles, means for moving said pusher in a feed stroke, locating means arranged to move with the pusher and adapted to exert light pressure on the upper surface of the batch during said feed stroke, and a brush member attached to the rear surface of said pusher and positioned to sweep particles from a surface over which a batch is moved by said pusher.

12. Apparatus for handling rod-like articles, comprising a surface for supporting a batch comprising a stack of rod-like articles, a pusher for moving the batch across said surface in a direction parallel to the lengths of the articles, means for moving the pusher in a feed stroke, and a brush member attached to the rear surface of the pusher and adapted to sweep particles from said surface.

13. Apparatus as claimed in claim 12, wherein said surface is the conveying surface of a conveyor arranged to deliver batches in a direction transverse to the lengths of the articles, said pusher being arranged to remove batches transversely of said conveyor.

14. Apparatus as claimed in claim 12, adapted for inserting batches of rod-like articles into a container, further comprising means for supporting a container and for intermittently moving the container to receive successive batches from the pusher.

15. Apparatus as claimed in claim 12, including a further surface spaced from said surface by a gap, wherein said pusher is arranged to move batches onto said further surface and said brush member is arranged to sweep particles into said gap.

16. Apparatus as claimed in claim 15, wherein said further surface is movable with said pusher during part of the feed stroke.

17. Apparatus as claimed in claim 12, further including a collecting station arranged to receive particles swept from said surface by said brush member, and means for moving particles away from the collecting station.

* * * * *